US007753361B2

(12) United States Patent
Lin et al.

(10) Patent No.: US 7,753,361 B2
(45) Date of Patent: Jul. 13, 2010

(54) PAPER FEEDING APPARATUS WITH DAMPING GEAR ON SWING ARM

(75) Inventors: Hsien-Chi Lin, Taichung (TW); Kung-Hsin Teng, Taichung (TW)

(73) Assignee: Asia Optical Co., Inc., Taichung (TW)

( * ) Notice: Subject to any disclaimer, the term of this patent is extended or adjusted under 35 U.S.C. 154(b) by 252 days.

(21) Appl. No.: 11/900,466

(22) Filed: Sep. 12, 2007

(65) Prior Publication Data

US 2008/0073826 A1 Mar. 27, 2008

(30) Foreign Application Priority Data

Sep. 21, 2006 (TW) ..... 95134959 A

(51) Int. Cl.
*B65H 3/06* (2006.01)

(52) U.S. Cl. ..... 271/117

(58) Field of Classification Search ..... 271/117
See application file for complete search history.

(56) References Cited

U.S. PATENT DOCUMENTS

2002/0084573 A1* 7/2002 Yu et al. ..... 271/116
2008/0024288 A1* 1/2008 Kageyama et al. ..... 340/461

FOREIGN PATENT DOCUMENTS

TW 479023 3/2002

* cited by examiner

*Primary Examiner*—Patrick Mackey
*Assistant Examiner*—Gerald W McClain
(74) *Attorney, Agent, or Firm*—Trop, Pruner & Hu, P.C.

(57) ABSTRACT

A paper feeding apparatus includes a driving shaft, a swing arm unit sleeved rotatably on the driving shaft, a pickup shaft disposed rotatably on the swing arm unit, and a device configured as an idle wheel unit or a damping gear. The device is interconnected between the driving shaft and the pickup shaft such that rotation of the driving shaft results in upward and downward pivoting movement of the pickup shaft, thereby allowing for paper loading and paper pickup, respectively.

2 Claims, 6 Drawing Sheets

PAPER FEEDING APPARATUS WITH DAMPING GEAR ON SWING ARM

CROSS-REFERENCE TO RELATED APPLICATION

This application claims priority of Taiwanese Application No. 095134959, filed on Sep. 21, 2006.

BACKGROUND OF THE INVENTION

1. Field of the Invention

This invention relates to an office machine, and more particularly to a paper feeding apparatus mounted on an office machine.

2. Description of the Related Art

Referring to FIG. 1, a conventional paper feeding apparatus includes a power driven driving shaft 1, a housing 2 sleeved rotatably on the driving shaft 1, a pickup shaft 3 disposed rotatably on the housing 2 and parallel to the driving shaft 1, an idle wheel 4 disposed between the driving shaft 1 and the pickup shaft 3, and a coiled compression spring 5. The driving shaft 1 includes a rear paper-feeding roller 101, and a first gear 102 connected coaxially and fixedly to the rear paper-feeding roller 101. The housing 2 has a connecting end portion 201 sleeved rotatably on the driving shaft 1, a free end portion 202 opposite to the connecting end portion 201, and an intermediate portion 203 interconnecting the connecting end portion 201 and the free end portion 202. The pickup shaft 3 is disposed rotatably on the free end portion 202, and includes a front paper-feeding roller 301 aligned with the rear paper-feeding roller 101, and a second gear 302 connected coaxially and fixedly to the front paper-feeding roller 301. The spring 5 is sleeved on the driving shaft 1 between a wall of the housing 2 and the rear paper-feeding roller 101.

Due to the pushing force of the spring 5 toward the housing 2 and the rear paper-feeding roller 101, when the driving shaft 1 is rotated, the housing 2 pivots about the driving shaft 1. As such, the housing 2 is pivotable between a first position whereat a paper loading operation can be performed such that a stack of papers can be placed onto a paper-supporting member (not shown), and a second position whereat a paper pickup operation can be performed such that one sheet of the stacked papers can be picked up by the paper feeding apparatus.

Since the spring 5 is sleeved on the driving shaft 1, the moment arm associated with the pushing force of the spring 6 applied to the driving shaft 1 and the housing 2 for pivoting the housing 2 about the driving shaft 1 is short. This necessitates the use of a large amount of power for rotating an assembly of the driving shaft 1 and the housing 2. Furthermore, it is difficult to mount the spring 5 between the driving shaft 1 and the housing 2.

SUMMARY OF THE INVENTION

The object of this invention is to provide a paper feeding apparatus that allows for paper loading and pickup operations without the use of a large amount of power and that can be assembled with ease.

According to an aspect of this invention, a paper feeding apparatus comprises:

a driving shaft rotatable about an axis and including a first roller and a first gear connected coaxially and fixedly to the first roller;

a swing arm unit having a connecting end portion sleeved rotatably on the driving shaft, a free end portion opposite to the connecting end portion, and an intermediate portion interconnecting the connecting end portion and the free end portion;

a pickup shaft disposed rotatably on the free end portion of the swing arm unit and parallel to the driving shaft, the pickup shaft including a second roller aligned with the first roller, and a second gear connected coaxially and fixedly to the second roller and aligned with the first gear; and an idle wheel unit disposed between the driving shaft and the pickup shaft and including an idle wheel body that is disposed rotatably on the intermediate portion of the swing arm unit and that meshes with the first and second gears, a locking member extending through the idle wheel body, and a friction member clamped between the locking member and the idle wheel body and in frictional contact with the idle wheel body.

According to another aspect of this invention, a paper feeding apparatus comprises:

a driving shaft rotatable about an axis and including a first roller and a first gear connected coaxially and fixedly to the first roller;

a swing arm unit having a connecting end portion sleeved rotatably on the driving shaft, a free end portion opposite to the connecting end portion, and an intermediate portion interconnecting the connecting end portion and the free end portion;

a pickup shaft disposed rotatably on the free end portion of the swing arm unit and parallel to the driving shaft, the pickup shaft including a second roller aligned with the first roller, and a second gear connected coaxially and fixedly to the second roller and aligned with the first gear; and a damping gear disposed between the driving shaft and the pickup shaft and including an idle wheel body that is disposed rotatably on the intermediate portion of the swing arm unit and that meshes with the first and second gears, and a damping member disposed between the idle wheel body and the intermediate portion of the swing arm unit for damping rotation of the idle wheel body relative to the swing arm unit.

Since the friction member and the damping gear are attached to the intermediate portion of the swing arm unit, the moment arm associated with the force applied between the driving shaft and the swing arm unit for pivoting the swing arm unit about the driving shaft is increased. Thus, a power necessary for rotating an assembly of the driving shaft and the swing arm unit can be reduced significantly. Furthermore, the paper feeding apparatus can be assembled with ease.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
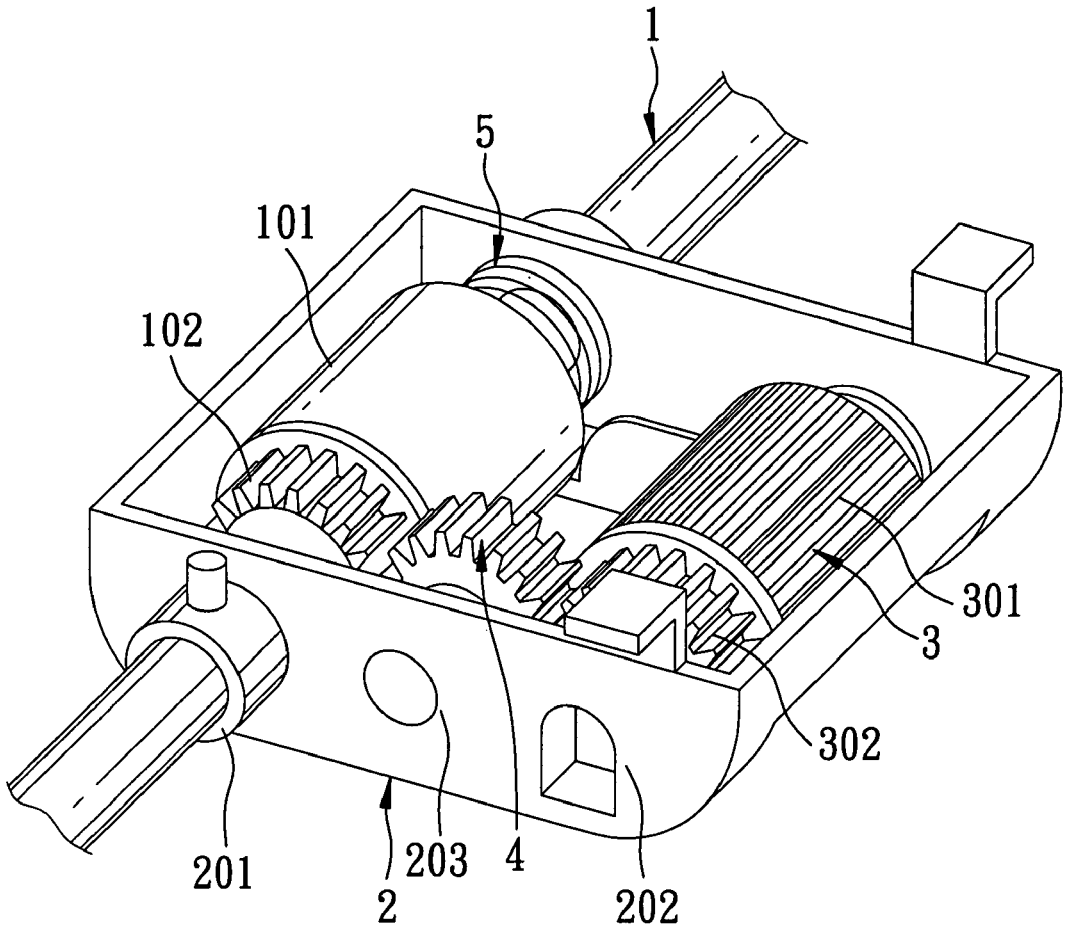
FIG. 1 PRIOR ART
FIG. 1 is a perspective view of a conventional paper feeding apparatus.

Before the present invention is described in greater detail in connection with the preferred embodiments, it should be noted that similar elements and structures are designated by like reference numerals throughout the entire disclosure.

Figure 2:
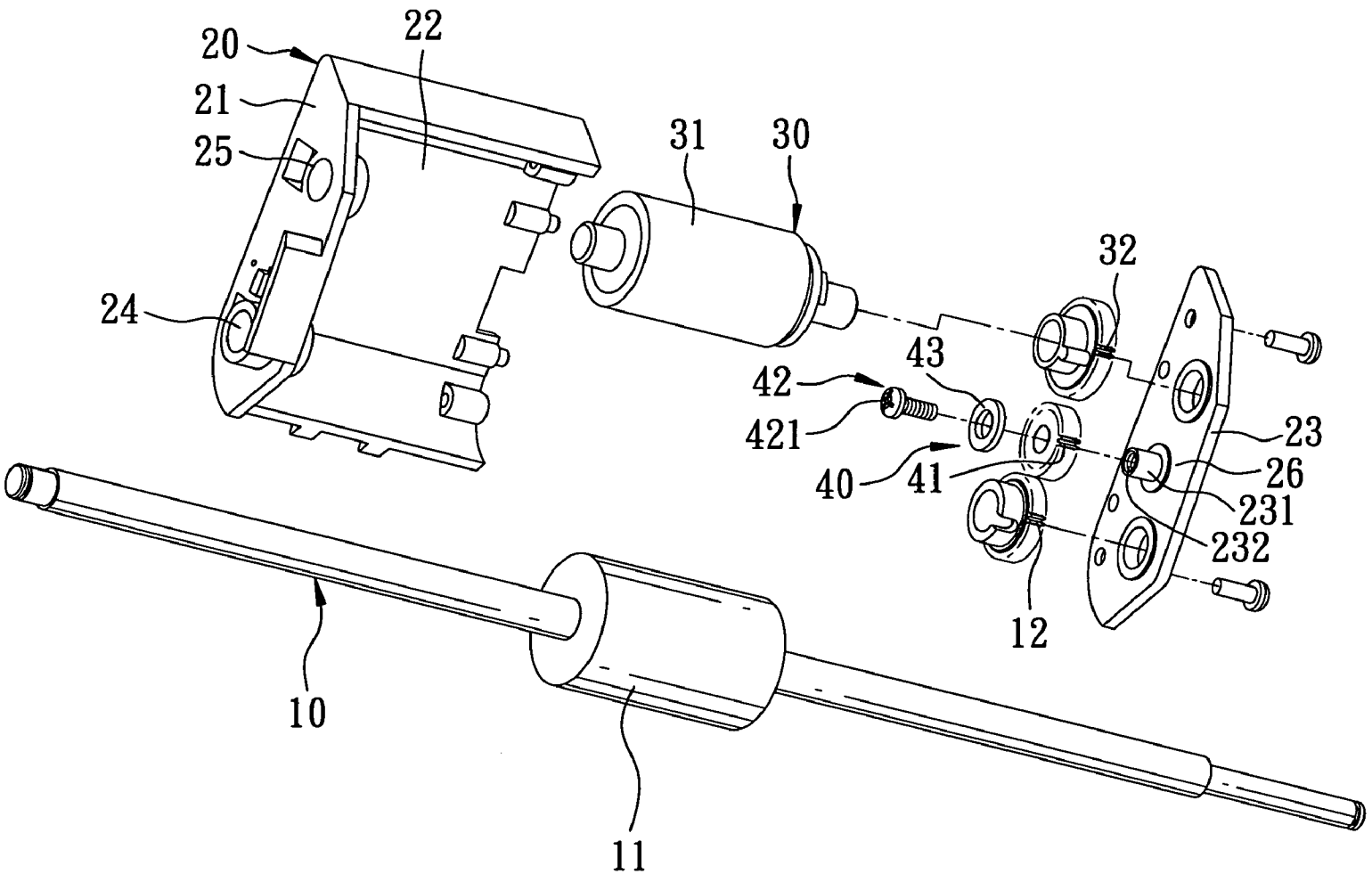
FIG. 2 is an exploded perspective view of the first preferred embodiment of a paper feeding apparatus according to this invention.
Figure 3:
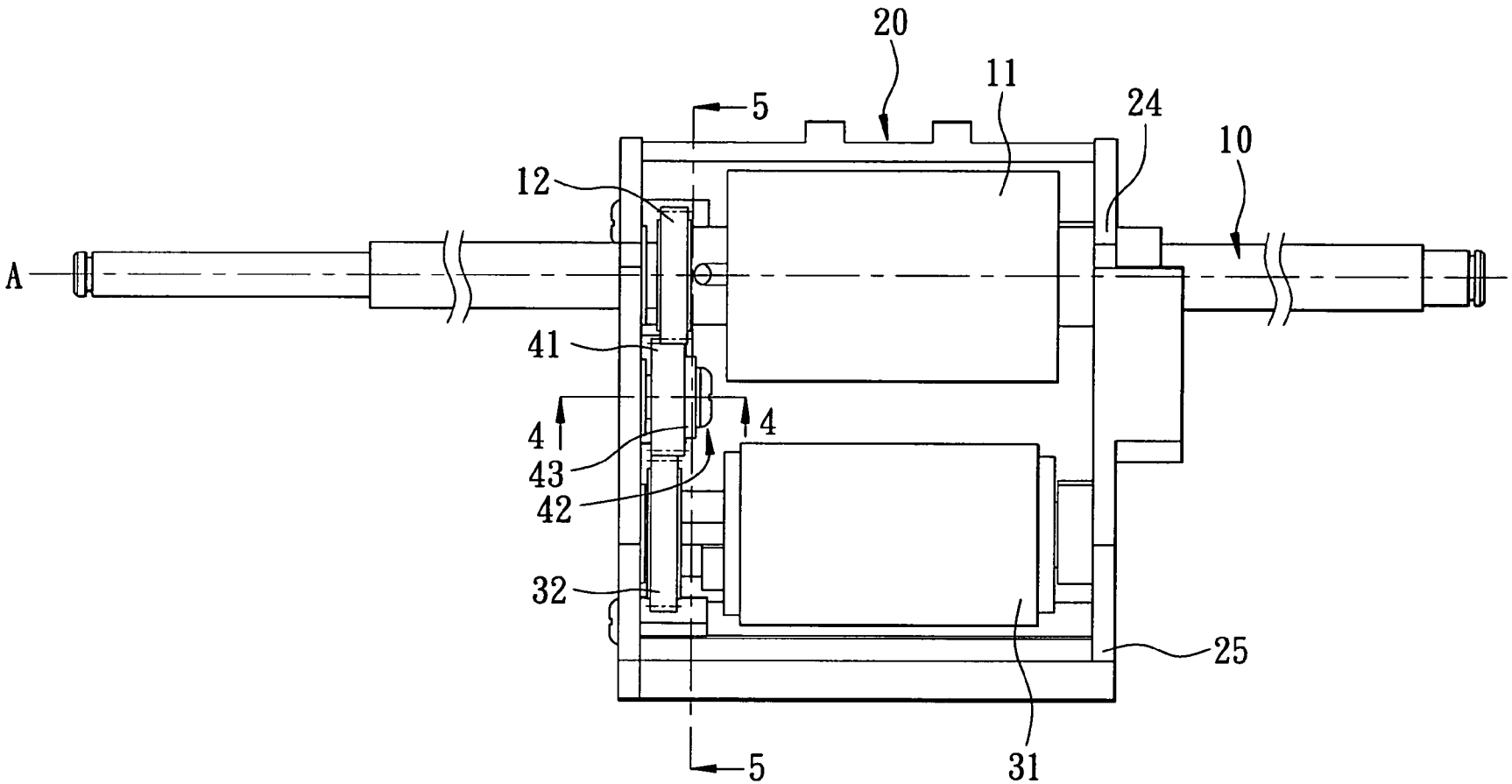
FIG. 3 is a side view of the first preferred embodiment.

Referring to FIGS. 2 and 3, the first preferred embodiment of a paper feeding apparatus according to this invention is mounted on an office machine (not shown), such as a copier, scanner, or printer, for purposes of automatic paper feeding. The paper feeding apparatus includes a driving shaft 10, a swing arm unit 20 sleeved rotatably on the driving shaft 10, a pickup shaft 30 disposed rotatably on the swing arm unit 20, and an idle wheel unit 40 disposed between the driving shaft 10 and the pickup shaft 30.

The driving shaft 10 is disposed rotatably on a housing of the office machine, is driven by a power source of the office machine to rotate about a central axis (A) thereof, and includes a first roller 11 and a first gear 12 connected coaxially and fixedly to the first roller 11.

The swing arm unit 20 includes a first side plate 21, a top plate 22 connected fixedly to a top side of the first side plate 21, and a second side plate 23 having a top side connected removably to the top plate 22 by bolts and aligned with the first side plate 21. The swing arm unit 20 has a connecting end portion 24 sleeved rotatably on the driving shaft 10, a free end portion 25 opposite to the connecting end portion 24, and an intermediate portion 26 interconnecting the connecting end portion 24 and the free end portion 25. The second side plate 23 is provided with a shaft tube 231 disposed fixedly thereon. The shaft tube 231 is disposed on the intermediate portion 26 of the swing arm unit 20.

The pickup shaft 30 is disposed rotatably on the free end portion 25 of the swing arm unit 20, is parallel to the driving shaft 10, and includes a second roller 31 aligned with the first roller 11, and a second gear 32 connected coaxially and fixedly to the second roller 31.

The idle wheel unit 40 includes an idle wheel body 41 meshing with the first and second gears 12, 32, a locking member 42 extending through the idle wheel body 41, and a friction member 43 clamped between the locking member 42 and the idle wheel body 41 and in frictional contact with the idle wheel body 41. The idle wheel body 41 is sleeved rotatably on the shaft tube 231. The locking member 42 is configured as a lock bolt that engages a threaded hole 232 in the shaft tube 231 and that has a bolt head 421. The friction member 43 is made of rubber or silica gel, is sleeved on the locking member 42, and is clamped between the bolt head 421 of the locking member 42 and the idle wheel body 41.

Figure 4:
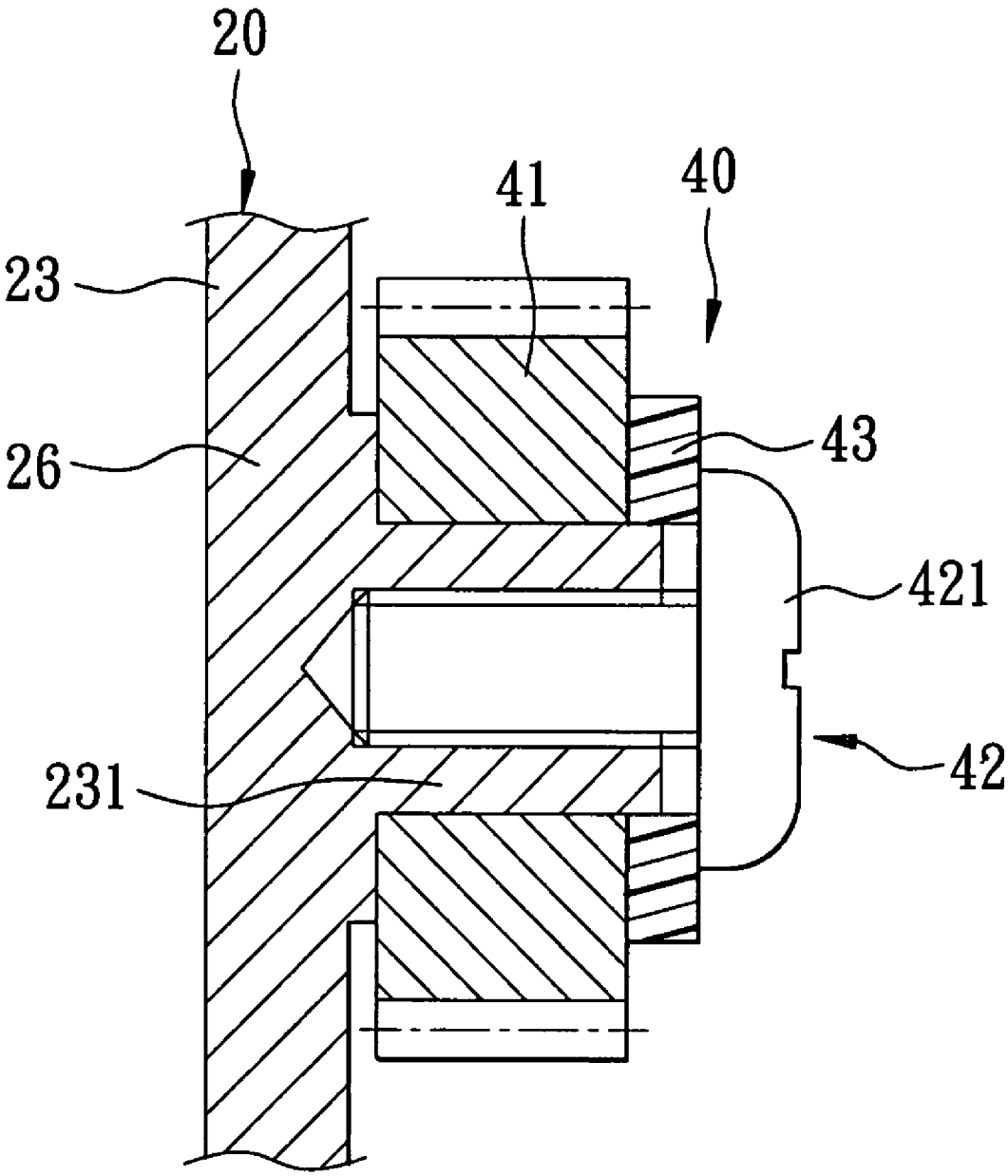
FIG. 4 is a sectional view taken along Line 4-4 in FIG. 3.
Figure 5:
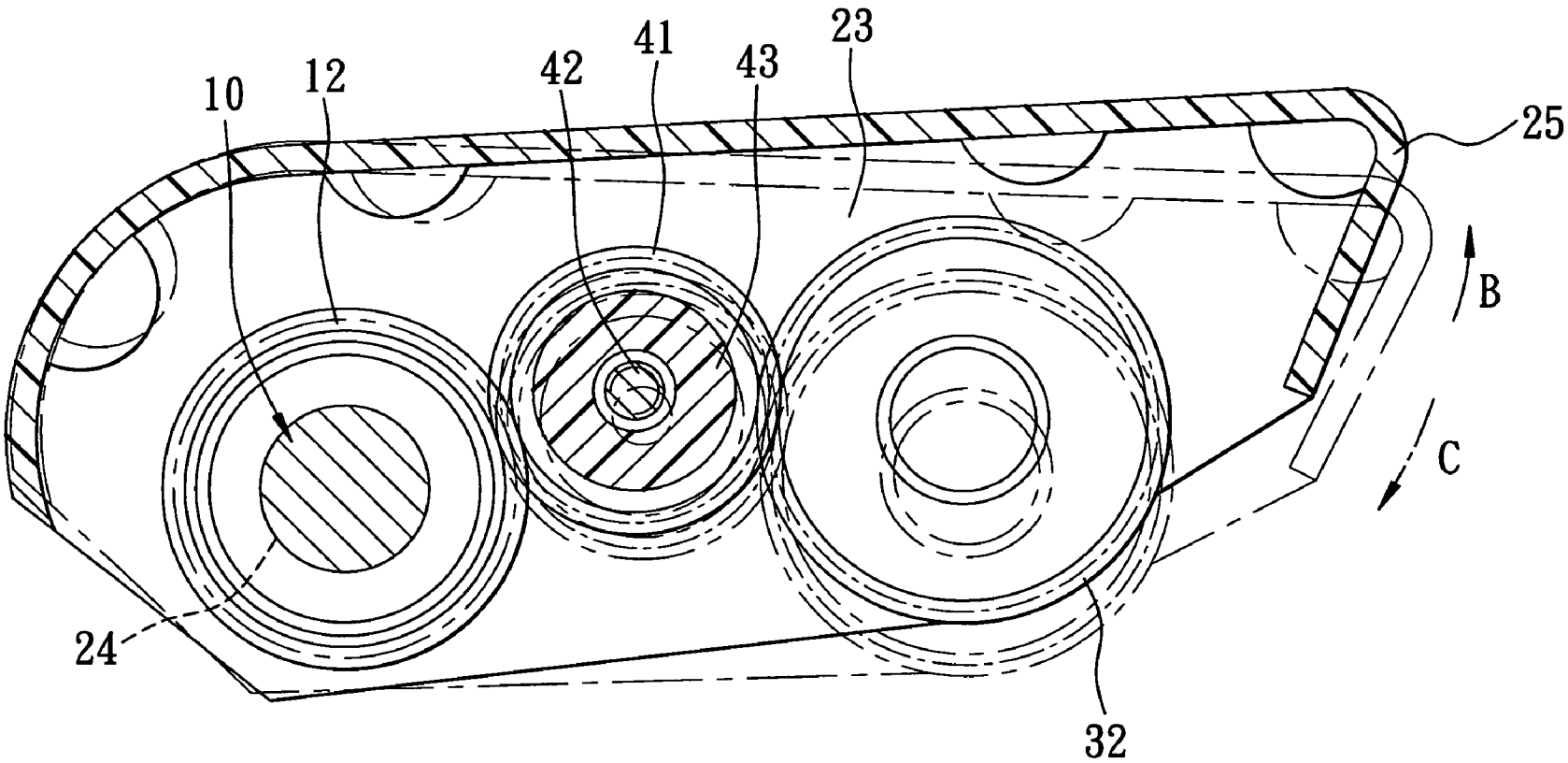
FIG. 5 is a sectional view taken along Line 5-5 in FIG. 3.

As shown by the solid lines in FIG. 5 and with further reference to FIG. 4, when the driving shaft 10 is rotated in a counterclockwise direction (B), a frictional force generated between the friction member 43 and the idle wheel body 41 is converted into a torque for pivoting the free end portion 25 of the swing arm unit 20 upwardly about the driving shaft 10. Hence, the second roller 31 is pivoted away from a paper-supporting member (not shown) so as to allow the user to place a stack of papers on the paper-supporting member.

As shown by the phantom lines in FIG. 5 and with further reference to FIG. 4, when the driving shaft 10 is rotated in a clockwise direction (C), a frictional force generated between the friction member 43 and the idle wheel body 41 is converted into a torque for pivoting the free end portion 25 of the swing arm unit 20 downwardly about the driving shaft 10. Hence, the second roller 31 is pivoted toward and brought into contact with the uppermost one of the stacked papers so as to move the uppermost paper away from the remaining papers.

As such, the moment arm associated with the frictional force for pivoting the swing arm unit 20 about the driving shaft 10 is greater than the moment arm in the above-mentioned prior art. Thus, the power necessary for rotating an assembly of the driving shaft 10 and the swing arm unit 20 can be reduced significantly. Furthermore, since the second side plate 23 is connected removably to the top plate 22, the idle wheel unit 40 can be assembled to the second side plate 23 prior to mounting of the second side plate 23 to the top plate 22. As a result, the paper feeding apparatus can be assembled with ease.

Figure 6:
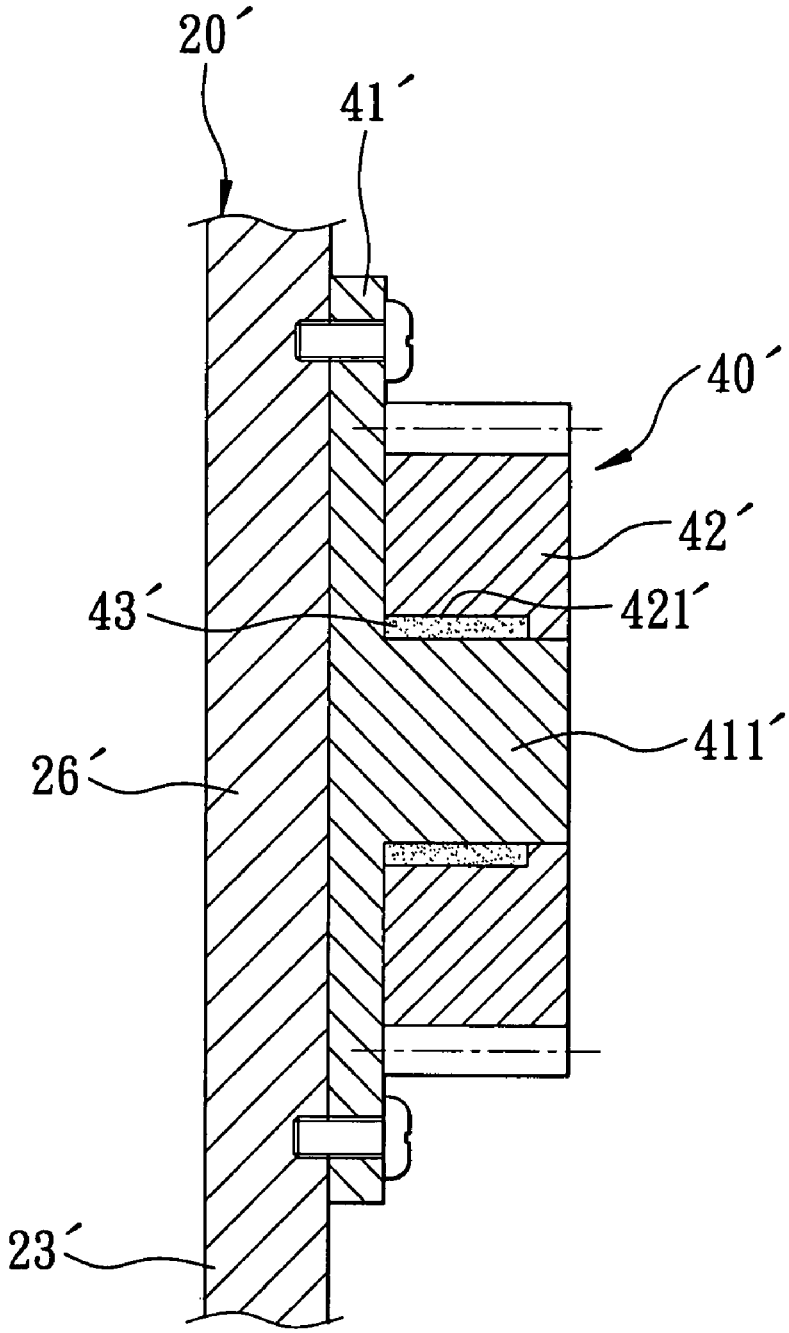
FIG. 6 is a fragmentary sectional view of the second preferred embodiment of a paper feeding apparatus according to this invention.

FIG. 6 shows the second preferred embodiment of a paper feeding apparatus according to this invention, which is similar in construction to the first preferred embodiment except that the idle wheel unit 40 is replaced with a damping gear 40'. The damping gear 40' is disposed on the intermediate portion 26' of the swing arm unit 20' and between the driving shaft 10 (see FIG. 2) and the pickup shaft 30 (see FIG. 2).

The damping gear 40' includes a mounting seat 41', an idle wheel body 42', and a damping member 43'. The mounting seat 41' is disposed fixedly on the second side plate 23', and is formed with an integral shaft rod 411'. The wheel body 42' is sleeved rotatably on the shaft rod 411', meshes with the first and second gears 12, 32 (see FIG. 2), and has an annular inner surface formed with an annular recess 421' so as to define an annular accommodating space between the idle wheel body 42' and the shaft rod 411'. The damping member 43' is configured as a high-viscosity oil. The accommodating space is filled with the damping member 43' so as to damp rotation of the idle wheel body 42' relative to the swing arm unit 20. Alternatively, the damping member 43' may be configured as an elastic frictional member.

As such, a frictional force generated between the damping member 43' and the idle wheel body 42' and between the damping member 43' and the shaft rod 411' is converted into a torque for pivoting the swing arm unit 20' about the driving shaft 10 (see FIG. 2).

With this invention thus explained, it is apparent that numerous modifications and variations can be made without departing from the scope and spirit of this invention. It is therefore intended that this invention be limited only as indicated by the appended claims.

We claim:

1. A paper feeding apparatus comprising:

a driving shaft rotatable about an axis and including a first roller and a first gear connected coaxially and fixedly to said first roller;

a swing arm unit having a connecting end portion sleeved rotatably on said driving shaft, a free end portion opposite to said connecting end portion, and an intermediate portion interconnecting said connecting end portion and said free end portion;

a pickup shaft disposed rotatably on said free end portion of said swing arm unit and parallel to said driving shaft, said pickup shaft including a second roller aligned with said first roller, and a second gear connected coaxially and fixedly to said second roller and aligned with said first gear; and a damping gear disposed between said driving shaft and said pickup shaft and including an idle wheel body that is disposed rotatably on said intermediate portion of said swing arm unit and that meshes with said first and second gears, and a damping member disposed between said idle wheel body and said intermediate portion of said swing arm unit for damping rotation of said idle wheel body relative to said swing arm unit;

wherein said swing arm unit includes two side plates each top side, and a top plate interconnecting said top sides of said side plates;

wherein one of said side plates is mounted removably to said top plate; and wherein said damping gear further includes a mounting seat disposed fixedly on said one of said side plates, said idle wheel body being disposed rotatably on said mounting seat, said damping member being configured as a high-viscosity oil and disposed between said idle wheel body and said mounting seat.

2. The paper feeding apparatus as claimed in claim 1, wherein said mounting seat is formed with a shaft rod, said idle wheel body being sleeved rotatably on said shaft rod and having an annular inner surface formed with an annular recess such that an annular accommodating space is defined between said idle wheel body and said shaft rod, said accommodating space being filled with said damping member.

* * * * *